US005079679A

United States Patent [19]

Chin-Fa

[11] Patent Number: 5,079,679

[45] Date of Patent: Jan. 7, 1992

[54] MULTI-PURPOSE TRAFFIC DIRECTOR'S STICK

[76] Inventor: Yen Chin-Fa, 5F, No. 10, Lane 560, Chung Cheng Rd., Hsinten, Taipei, Hsien, Taiwan

[21] Appl. No.: 573,463

[22] Filed: Aug. 27, 1990

[51] Int. Cl.[5] ..... A45B 3/04; A63B 15/02

[52] U.S. Cl. ..... 362/102; 362/800; 362/184; 362/202; 362/253

[58] Field of Search ..... 362/102, 800, 331, 399, 362/234, 205, 202, 186, 184, 253

[56] References Cited

U.S. PATENT DOCUMENTS

| | | | |
|---|---|---|---|
| 278,387 | 4/1985 | Bixler | 362/102 |
| 666,683 | 1/1901 | Mygatt | 362/331 |
| 2,855,499 | 10/1958 | Lewis | 362/202 |
| 2,908,901 | 10/1959 | Lewis | 362/102 |
| 4,055,840 | 10/1977 | Uchytil et al. | 362/202 |
| 4,062,371 | 12/1977 | Bolen | 362/102 |
| 4,345,305 | 8/1982 | Kolm et al. | 362/102 |
| 4,583,080 | 4/1986 | Divito et al. | 362/102 |
| 4,588,387 | 5/1986 | Swenson | 362/205 |
| 4,625,742 | 12/1986 | Phillips | 362/102 |
| 4,703,402 | 10/1987 | Hsieh | 362/102 |
| 4,744,013 | 5/1988 | Lee et al. | 362/202 |
| 4,761,720 | 8/1988 | Solow | 362/800 |
| 4,835,665 | 5/1989 | Kao | 362/184 |
| 4,924,358 | 5/1990 | Von Heck | 362/102 |
| 4,967,321 | 10/1990 | Cimock | 362/202 |

FOREIGN PATENT DOCUMENTS

| | | | |
|---|---|---|---|
| 987063 | 8/1951 | France | 362/102 |
| 1267321 | 6/1961 | France | 362/234 |

*Primary Examiner*—Ira S. Lazarus
*Assistant Examiner*—Y. Quach
*Attorney, Agent, or Firm*—Dvorak and Traub

[57] ABSTRACT

This invention relates to a type of "multi-purpose traffic director's stick", featuring the composition of a bar tube, flashlight handle, lamp element, speaker and control circuit board, to achieve multiple purposes with a single director's stick without sophisticated equipment but the functions provided by a director's stick, police club, trouble alarm lamp, flashlight and a whistle. In which, the outside tube wall includes several vertical and horizontal sectors, to ensure best light-converging effect of the stick and even illumination and at the end of the handle is a flashlight to provide a lighting function, also a control circuit board so the speaker can produce a whistle and the lamp element (neon tube or aligned LED strip) to produce a flashing effect, so the person on duty can produce a whistle (without opening his mouth) when he is wearing a mask, and at time or traffic accident of engine failure, it can be placed at an appropriate distance behind the car, to serve as an alarm for hazards, to prevent collisons, so it is indeed an excellent invention with practical use and creativeness.

6 Claims, 3 Drawing Sheets

MULTI-PURPOSE TRAFFIC DIRECTOR'S STICK

BACKGROUND OF THE INVENTION

This invention relates to a type of "MULTI-PURPOSE TRAFFIC DIRECTOR'S STICK", comprising a bar tube, flashlight handle, lamp element, speaker and control circuitboard. Multiple purposes are achieved with a single director's stick, without sophisticated equipment, including the functions provided by a director's stick, police club, warning lamp, flashlight, and whistle. The outside tube wall includes several vertical and horizontal sectors, which optimize the light-converging effect of the stick, and provide for even illumination. At the end of the handle is a flashlight to provide a lighting function, a control circuitboard so the user can produce a whistle, and a lamp element (neon tube or aligned LED strip) to produce a flashing effect. Utilizing this device, the user can produce a whistle (without opening his mouth) when he is wearing a mask. In the event of a traffic accident or engine failure, the device can be placed at an appropriate distance behind the car, to serve as a warning for hazards, and to prevent collisions. The device is indeed an excellent, creative invention, having many practical uses.

In a conventional traffic director's stick, the stick tube consists primarily of semi-transparent and colored plastic material. Near the end of the tube at the handle joint is a multi-ring convex lens. Light is produced by means of the lamp at an end joint of the tube at the top of the handle. The tube can produce lighting, but with such a mechanism, because the lamp and the multi-ring convex lens focus cannot be fixed, the reflective light angle cannot be optimized, and the small lamp's brightness is thereby limited. In addition, the conventional director's stick produces dim and uneven light, and cannot produce a significant warning effect. With the conventional directing stick, which has merely a single function, if the person on duty must blow his whistle, he cannot simultaneously wear a mask (when traffic is heavy and pollution is serious). The municipal traffic police unit has spent much money in the purchase of ugly filters which are difficult and uncomfortable to wear. When the traffic director has a necessity to blow his whistle, dirty air is aspirated. Much money is spent without achieving a better result. Economic efficiency is not achieved. When the traffic director needs to look at an identification document during nighttime duty, he must bring a flashlight for illumination. Therefore, the person on duty must be equipped with various appliances to perform his duty, which results in difficulties in the routine execution of that duty. When necessary, this stick tube can serve the purpose of a police club, to stop a lawbreaker in an instant, to avoid attack when inspecting an identity document.

For this purpose, the inventor has been actively engaged in the study of a solution to this problem, spending effort in design and research in the development of a "MULTI-PURPOSE DIRECTING STICK". In the present invention, a lamp tube (neon lamp or aligned LED strips) ensures even distribution of light. The tube strip emits light in a manner different from conventional "spot" light emission. The longitudinal and latitudinal arc sectors on the inside and outside walls of the tube produce the best light converging effect. The inside longitudinal and outside latitudinal design facilitates easy removal from the mold, and also allows the light to form intensive dots. At the end of the handle is a flashlight to provide illumination, and a control circuitboard so the speaker can produce a whistle sound. The lamp tube will produce a flashing effect, so the person on duty can wear a comfortable mask and can simultaneously execute his duty by blowing the whistle. The stick can be placed at an appropriate distance from a disabled car to achieve a warning effect, and can be used as a multiple purpose directing stick having the combined functions of a directing stick, police club, whistle, flashlight, and car failure warning lamp. The device creates a better warning effect, and enables easier use.

SUMMARY OF THE INVENTION

This invention relates to a type of "MULTI-PURPOSE TRAFFIC DIRECTOR'S STICK", particularly to one featuring reflective surfaces with a special design on the inside and outside walls, so as to to optimize the stick's light converging effect. At the end of the stick handle is a flashlight. In addition, there is a circuitboard connected to a speaker and lamp tube (neon lamp tube or aligned LED strips). The lamp tube will, besides permanent illumination status, serve as a directing stick, and can produce a flashing effect to serve the purpose of a warning lamp behind a car in the event of an accident or engine failure. The circuitboard enables the speaker to produce a whistle (electronic whistle), so the traffic director does not need to physically blow into the device, but the device can perform the same effect as blowing a whistle. The subject invention can become a multi-purpose directing stick, with the combination of directing stick, police club, car accident or failure warning lamp, flashlight, and whistle.

BRIEF DESCRIPTION OF THE DRAWINGS

FIG. 3-1 is a section view of the tube.

DETAILED DESCRIPTION OF THE PREFERRED EMBODIMENTS

Figure 1:
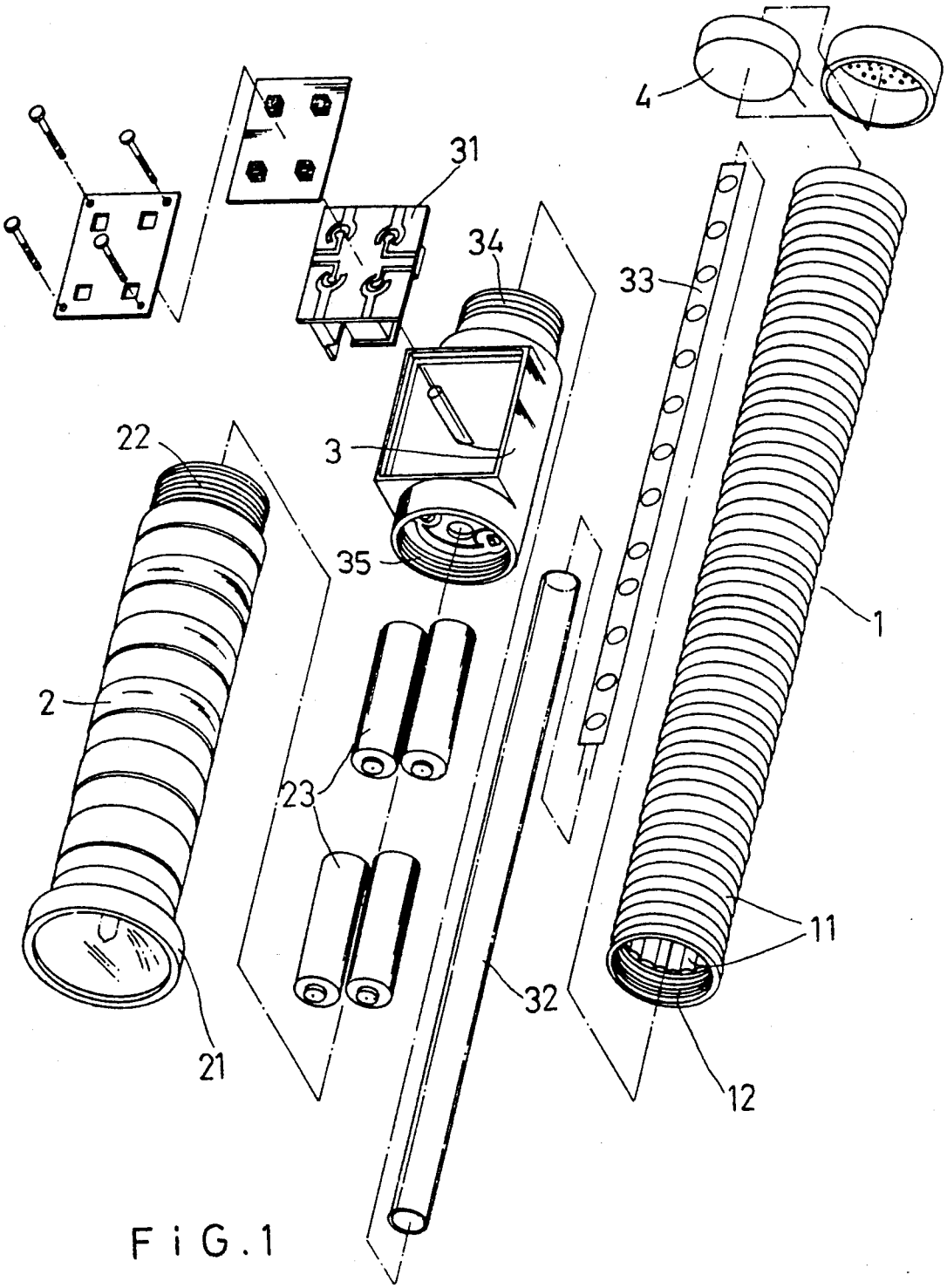
FIG. 1 is an exploded view of the subject invention.
Figure 3:
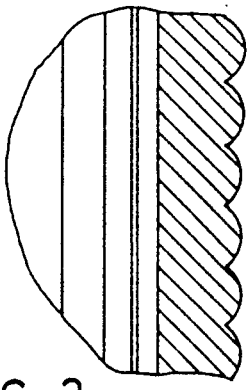
FIG. 3 is a sectional view of the tube.
Figures 1, 3:
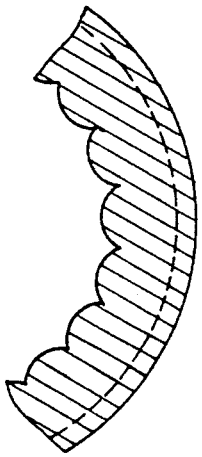
Figure 2:
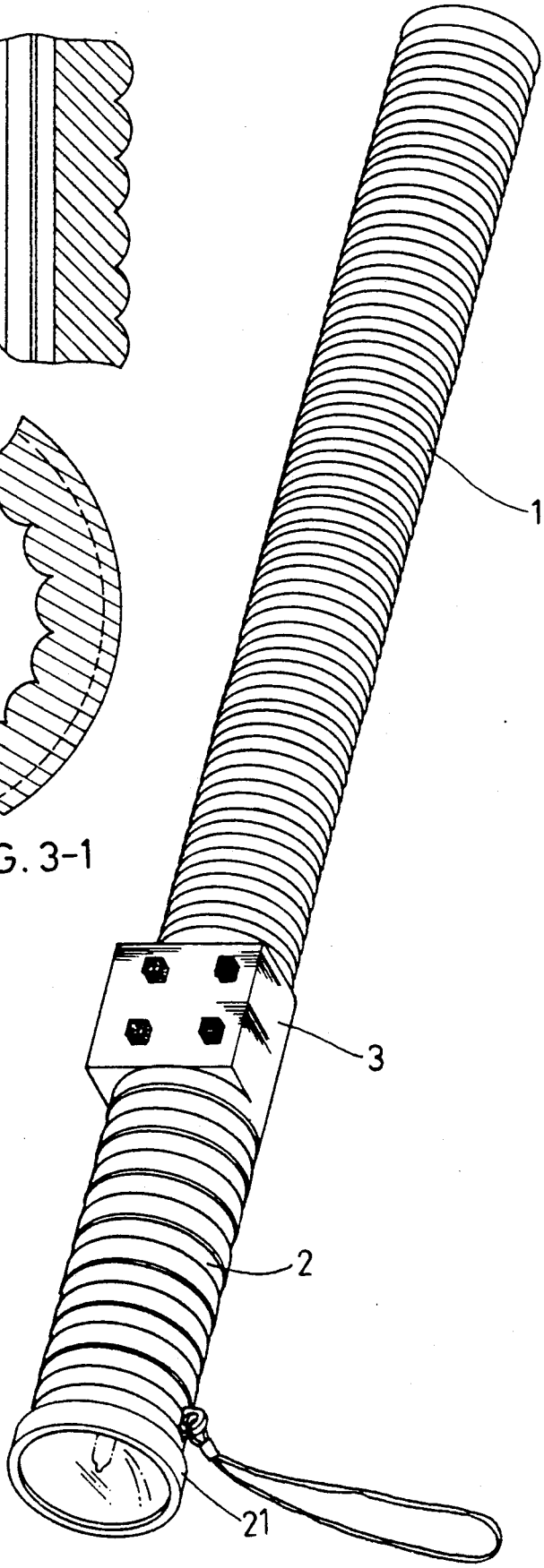
FIG. 2 is a perspective view of the subject invention.
Figure 4:
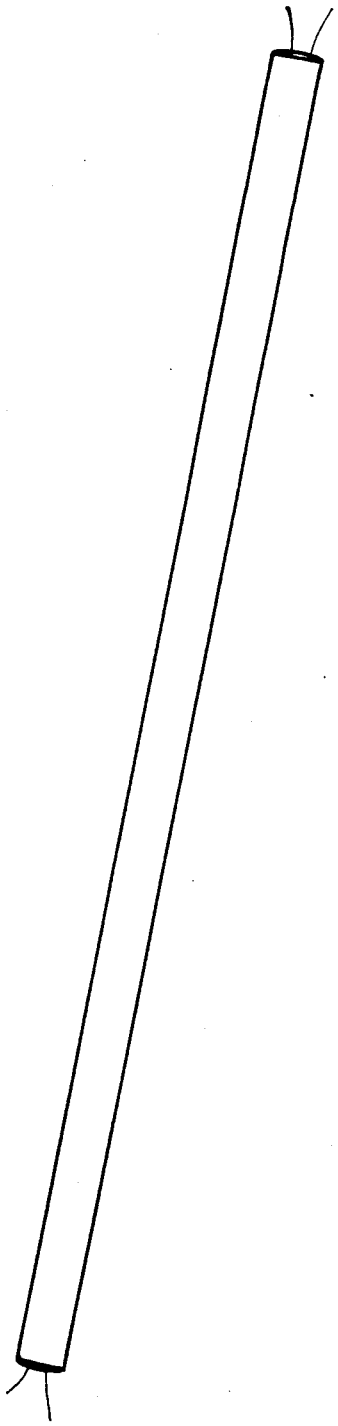
FIG. 4 is a top view of the neon tube.

Referring to FIGS. 1 and 2, the subject invention includes several inside longitudinal and outside latitudinal arc sectors on the inside and outside walls, respectively. Such longitudinal and latitudinal sectors (11) are interlaced to form several light converging blocks, which receive light from the LED strips (33) (or neon lamp tube). If light is produced by LED strips, the LED adopts a double-piece type (back to back), or a single-piece type (double face) light emission mode. If the light source is a neon tube having four-side even light, there is no difference between a positive side or reverse side. It does not matter if there are LED strips or a neon tube mounted in the tube, because of the tube's longitudinal and latitudinal strips which produce light converging blocks. An even lighting effect is produced along the whole piece of tube. These light converging blocks allow for even emission of multiple lighting dots. In the dark, a conspicuous warning effect is produced. At the outside of the LED strips is a fixing joint (3) which fixes and protects the tube (32), and protects and positions the LED strips (33). At the end of handle (2) is a flashlight (21). Inside the handle (2) is a battery (23). The thread (22) and thread (35) are locked together, so the handle (2) and joint (3) are joined. A control circuitboard (31) controls the various functions. The speaker (4) at the front end of the tube (1) emits a whistle sound to replace a conventional whistle. The LED strips (33) can produce a permanent lighting or flashing effect. This invention can be placed on the site of a traffic accident or at an appropriate distance behind a car with engine failure, to serve as a warning, and to prevent collisions. The tube (1) is locked with thread (12) and thread (34) to become one unit with the joint (3).

What is claimed:

1. A multi-purpose directing stick, comprising:

a light-transmitting hollow bar tube having an inside and an outside wall;

a handle fixable to a proximate end of said bar tube;

a joint disposed between said bar tube and said handle;

a manually-operated control board mounted on said joint;

a whistle-producing speaker fixable to a distal end of said bar tube, said speaker being electrically connected to said control board;

a longitudinal affixing and protecting tube disposed within said bar tube;

a longitudinal light source disposed within said protecting tube, said light source being electrically connected to said control board; and a flashlight disposed in said handle, said flashlight being electrically connected to said control board;

wherein said control board controls the operation of said light source, said flashlight, and said whistle-producing speaker.

2. A multi-purpose directing stick, according to claim 1, wherein said light source is an LED strip.

3. A multi-purpose directing stick, according to claim 1, wherein said light source is a neon tube.

4. A multi-purpose directing stick, according to claim 1, further comprising longitudinal strip sections disposed along said inside walls.

5. A multi-purpose directing stick, according to claim 1, further comprising latitudinal radial arc sections disposed around said outside walls.

6. A multi-purpose directing stick, according to claim 1, wherein said light source is arranged and constructed to flash intermittently.

* * * * *